US005816027A

United States Patent [19]

Li

[11] Patent Number: 5,816,027

[45] Date of Patent: Oct. 6, 1998

[54] METHOD FOR MANUFACTURING STACKABLE PLASTIC HANDLE BAGS WITH RELEASABLE ADHESIVE

[75] Inventor: Nam T. Li, Alhambra, Calif.

[73] Assignee: E-Z Plastic Packaging Corporation, Commerce, Calif.

[21] Appl. No.: 871,914

[22] Filed: Jun. 9, 1997

[51] Int. Cl.[6] ..... B65D 33/14

[52] U.S. Cl. ..... 53/443; 206/554; 383/9; 493/194

[58] Field of Search ..... 206/554; 383/7, 383/9; 53/443; 493/194

[56] References Cited

U.S. PATENT DOCUMENTS

| | | | |
|---|---|---|---|
| Re. 33,264 | 7/1990 | Baxley et al. | 206/554 |
| 4,423,819 | 1/1984 | Cummings | 215/232 |
| 4,676,378 | 6/1987 | Baxley et al. | 206/554 |
| 4,796,759 | 1/1989 | Schisler | 206/554 |
| 4,849,090 | 7/1989 | Case et al. | 53/443 |
| 4,904,092 | 2/1990 | Campbell et al. | 383/35 |
| 5,074,674 | 12/1991 | Kuklies et al. | 383/8 |
| 5,307,935 | 5/1994 | Kemanjian | 206/554 |
| 5,333,730 | 8/1994 | Boyd | 206/554 |
| 5,335,788 | 8/1994 | Beasley et al. | 206/554 |
| 5,363,965 | 11/1994 | Nguyen | 206/554 |
| 5,464,098 | 11/1995 | Tseng et al. | 206/554 |
| 5,465,845 | 11/1995 | Norby et al. | 206/554 |
| 5,467,572 | 11/1995 | Wile et al. | 206/554 |
| 5,469,970 | 11/1995 | Li | 206/554 |

*Primary Examiner*—Jimmy G. Foster
*Attorney, Agent, or Firm*—Sheldon & Mak

[57] ABSTRACT

A handle bag 16 in a bag pack 2 suitable for suspension and opening on a bag rack 4 has a front wall 22, a rear wall 24, a pair of laterally spaced handles 20, and an area of a cold releasable adhesive 8 between the rear wall 24 of the bag 16 and the front wall 42 of its immediately subsequent bag 40. The front wall 22 is joined opposite the rear wall 24 and defines an enclosure 26 having an open top 28, opposed two sides 30 and a bottom 32. The handles 20 and the opposed sides 30 are substantially symmetric with respect to a longitudinal axis 50. The area of the cold releasable adhesive 8 is centered about the longitudinal axis 50 and is positioned closer to the open top 28 than to the bottom 32. The area of the cold releasable adhesive 8 is preferably in the range of about 1 sq. inch to about 4 sq. inches. The cold releasable adhesive 8 is preferably a water-based adhesive with a relatively high water volume content prior to application, and it is preferred that the adhesive 8 produce a relatively small peel strength and a relatively high shear strength between the bag walls 24 and 42 after it dries.

14 Claims, 5 Drawing Sheets

METHOD FOR MANUFACTURING STACKABLE PLASTIC HANDLE BAGS WITH RELEASABLE ADHESIVE

BACKGROUND

The present invention relates to a pack of stackable plastic handle bags, commonly referred to as T-shirt bags, and in particular to a pack of stackable plastic handle bags with releasable adhesives between the bags to form the bag pack.

The use of plastic shopping bags in grocery stores, supermarkets, department stores and other stores is well known. To expedite the bagging process, individual plastic bags neatly stacked in a bag pack for suspension on a conventional bag rack are commonly used.

A conventional bag rack generally includes two substantially parallel, outwardly extending, laterally spaced support arms and a center hook supporting the bags in the bag pack. The individual bags have laterally spaced handles with handle apertures extending therethrough for receiving the support arms and a removable center mount for receiving the center hook. Pin welds can optionally be used to hold the individual bags together in the bag pack.

In operation, the bag pack is supported by the bag rack by suspending the bag handles on the support arms and attaching the center mount onto the center hook. A bagger, such as a store cashier, prepares a bag for loading by pulling a front wall of the front bag in the bag pack away from the bag pack, thereby separating the front wall from the center mount and the center hook. In this position, the support arms which extend through the handle apertures support the bag during loading. When the loading is completed, the bag is removed from the support arms and the bag immediately subsequent to the removed bag is pulled open on the support arms by the bagger.

The pin welds which are used in some conventional bagging systems to hold the bags in the bag pack sometimes cause the individual bags difficult to separate. Static charge between the individual plastic bags sometimes accumulates to cause the bags to attract and stick to each other. Therefore, the bagger's time is wasted grappling for the next bag. Accordingly, to expedite the bagging process, it has become important to make each subsequent individual bag in the bag pack open upon removal of the previous bag.

In an attempt to solve this problem, other conventional bag packs have been designed by attaching the rear wall of each individual bag in the bag pack to the front wall of the immediately subsequent bag in the bag pack. Thus, when a bag is removed from the bag rack, the subsequent bag is opened on the bag rack. In one approach, a small area of an adhesive is used to attach the rear wall of each bag to the front wall of its immediately subsequent bag. However, this approach has had limited success since the adhesive often does not easily disengage, causing a plurality of subsequent bags to be pulled off the bag rack before the adhesive bond is broken, or the adhesive bond breaks prior to the next bag being opened on the bag rack.

Another type of conventional bag pack uses a hot melt adhesive between the walls of the individual plastic bags in the bag pack. The hot melt adhesive is applied in a small spot area on the walls of each bag. Because of the high peel strength of the hot melt adhesive, when a bag is removed from the bag rack it cannot be easily separated from its immediately subsequent bag. Because the hot melt adhesive is strong, one hand may be required to hold the subsequent bags in the bag pack while the other hand pulls the first bag away from the bag pack.

Another bag pack design, disclosed in U.S. Pat. No. 5,469,970, issued to Nam T. Li, the inventor of the present invention, uses an adhesive between the rear wall of each bag and the front wall of its immediately subsequent bag in the bag pack in an area offset from the center of the bag. While the bags in the bag pack are relatively easy to open, the area of the opening of each bag is limited by the offset adhesion of the back wall to the front wall to the front wall of its immediately subsequent bag. In some applications, it is inconvenient for the bagger to place large items into the bag through the limited openings offered by the offset adhesion of the bag.

Therefore, there is presently a need for a convenient and reliable bag pack system to allow the bagger to open each individual bag in the bag pack with a sufficiently large opening while causing its immediately subsequent bag to be opened individually upon removal of the immediately preceding bag from the rack.

SUMMARY OF THE INVENTION

The present invention satisfies these needs. In view of the above problems, the present invention provides a stackable handle bag with a cold releasable adhesive in a relatively large area on the bag walls centered about the longitudinal axis of the bag. In one embodiment, the stackable handle bag generally comprises:

(a) a front wall having a longitudinal axis;

(b) a rear wall having a longitudinal axis coinciding with the longitudinal axis of the front wall, the rear wall joined opposite the front wall defining an enclosure having an open top, opposed sides and a bottom;

(c) a pair of laterally spaced handles integral with the front and rear walls extending upwardly from the open top, each handle having a handle aperture extending therethrough for receiving one of the support arms of the bag rack;

(d) a releasable center mount attached to the front and rear walls on the longitudinal axis of the walls adjacent the open top for receiving the center hook of the bag rack, the center mount releasably supporting the bag; and (e) an area of a cold releasable adhesive on the rear wall, the area of the cold releasable adhesive substantially centered about the longitudinal axis and positioned closer to the open top than to the bottom, the cold releasable adhesive adapted to releasably adhere to the front wall of the immediately subsequent bag, the area of the cold releasable adhesive sufficiently large so that the force required to release the cold releasable adhesive is greater than the force required to release the center mount when the front wall is pulled from the back wall of the same bag, and when the bag is removed from the bag rack by its handles, the force required to release the cold releasable adhesive is less than the force required to continue to pull the immediately subsequent bag out of the bag rack.

The present invention also provides a bag pack of stackable bags suitable for suspension by laterally spaced support arms and a center hook of a bag rack, the bag pack comprising:

(a) a plurality of aligned stackable bags, each bag comprising:

(i) a front wall having a longitudinal axis;

(ii) a rear wall having a longitudinal axis coinciding with the longitudinal axis of the front wall, the rear wall joined opposite the front wall defining an enclosure having an open top, opposed sides and a bottom;

(iii) a pair of laterally spaced handles integral with the front and rear walls extending upwardly from the open top, each handle having a handle aperture extending therethrough for receiving one of the support arms of the bag rack;

(iv) a releasable center mount attached to the front and rear walls on the longitudinal axis of the walls adjacent the open top for receiving the center hook of the bag rack, the center mount releasably supporting the bag; and (b) an area of a cold releasable adhesive on the rear wall of each bag and on the front wall of each immediately subsequently bag in the bag pack, the area of the cold releasable adhesive substantially centered about the longitudinal axis and positioned closer to the open top than to the bottom, the cold releasable adhesive adaptive to releasably adhere to the rear wall of each bag with the front wall of each immediately subsequent bag in the bag pack, the area of the cold releasable adhesive sufficiently large so that the force required to release the cold releasable adhesive is greater than the force required to release the center mount when the front wall is pulled from the back wall of the same bag, and when the bag is removed from the bag rack by its handles, the force required to release the cold releasable adhesive is less than the force required to continue to pull the immediately subsequent bag out of the bag rack.

Preferably, the cold releasable adhesive is water-based with about 60% water by volume prior to application on the bags to provide the necessary adhesive force. It is further preferred that the area of the cold releasable adhesive be relatively large, for example, in the range of about 1 sq. inch to about 4 sq. inches. For ease of manufacturing, the area of the cold releasable adhesive can be of an approximately circular shape with a diameter of about 2 inches when the bags are stacked together in the bag pack.

Advantageously, the area of the cold releasable adhesive is positioned on the bag walls below the center mount and closer to the open top than to the bottom, and centered about the longitudinal axis of the bags. When a bag is pulled open, the opening of the bag is much larger than the type of bag which is adhered to its subsequent bag by an area of adhesive offset from the longitudinal axis of the bags. Moreover, because the adhesive used occupies a relatively large area with a relatively small peel strength per unit area, the walls of the opened bag and of the immediately subsequent bag retain their integrity when they are pulled apart from each other, thereby avoiding tearing the bag walls when the opened bag is removed from the bag rack.

BRIEF DESCRIPTION OF THE DRAWINGS

These and other features, aspects, and advantages of the present invention will become understood with references to the following description, appended claims, and accompanying drawings where:

DETAILED DESCRIPTION OF THE PREFERRED EMBODIMENTS

Figure 1:
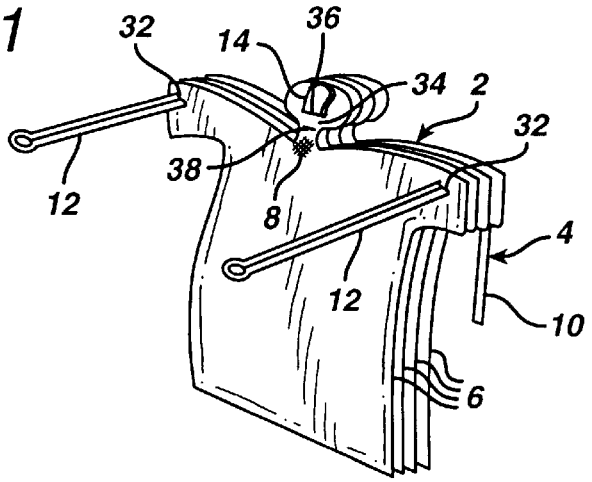
FIG. 1 is a perspective view of a bag pack mounted on a bag rack.

The present invention provides a handle bag in a bag pack with a relatively large area of a cold releasable adhesive between walls of adjacent bags in the bag pack that is suitable for suspension by a bag rack with laterally spaced support arms and a center hook. Specifically, each bag in the bag pack is substantially symmetric about a longitudinal axis, and the area of the cold releasable adhesive is substantially centered about the longitudinal axis of the bag. When a bag is pulled from the bag rack by its handles, the force required to release the cold releasable adhesive is less than the force required to continue to pull its immediately subsequent bag out of the bag rack. Detailed descriptions of preferred embodiments of the present invention are described as follows:

FIG. 1 is a perspective view of a bag pack 2 in accordance with the present invention mounted on a conventional bag rack 4. The bag pack 2 according to the present invention comprises a plurality of aligned individually stackable handle bags 6, commonly known as T-shirt bags, with an area of a releasable adhesive 8 between the individual bags.

The bag pack 2 is mounted on the bag rack 4, which typically comprises a frame 10 having a pair of laterally spaced, outwardly extending support arms 12. The bag rack 4 typically further includes a center hook 14 centered between the support arms 12. The center hook 14 is also generally supported by the frame 10 of the bag rack 4. The bag rack 4 is well known in the industry, and it is described in further detail in U.S. Pat. No. Re. 33,264, issued to Baxley, et al., and U.S. Pat. No. 5,074,674, issued to Kuklies, et al.

Figure 2:
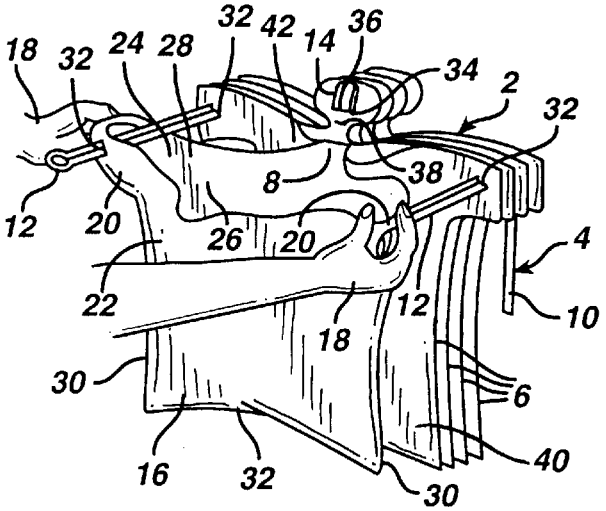
FIG. 2 is a perspective view of the bag pack of FIG. 1 with a selected bag open on the bag rack.

FIG. 2 shows a perspective view of the bag pack 2 of FIG. 1 with a bag 16 in the bag pack 2 immediately facing a bagger (not shown) opened by the hands 18 of the bagger while the bag 16 is suspended on the support arms 12 of the bag rack 4. The bag 16, which is identical to other bags 6 in the bag pack 2, has a front wall 22 and a rear wall 24 which is joined opposite the front wall 22 to define a bag enclosure 26 having an open top 28 and closed opposed sides 30 and a bottom 32. The bag 16 also includes a pair of laterally spaced handles 20 integral with the front and rear walls 22 and 24 extending upwardly from the open top 28, each handle having at least one handle aperture 32 that is sized to fit one of the support arms 12 of the bag rack 4. The support arms 12 of the bag rack 4 extend through the handle apertures 32 of individual bags 6 in the bag pack 2, and support the weight of the bag pack 2 as well as any items (not shown) placed in the opened bag 16.

When the bag pack 2 is mounted on a bag rack 4 with a center hook 14, a center mount 34 is preferably provided at the open top 28 of each individual bag in the bag pack 2 for attachment onto the center hook 14 of the bag rack 4. The center hook 14 of the bag rack 4 preferably holds the center mounts 34 of the bags 6 in the bag pack 2 to provide additional weight support for the bags 6. As shown in the drawings, the center mount 34 can be a detachable tab as described in U.S. Pat. No. Re. 33,264, having a mount aperture 36 for receiving the center hook 14 and a lower aperture 38 to facilitate detachment of bags from the center mount 34 when the bags are individually pulled from the bag rack 4. Alternatively, the center mount 34 can be an aperture or slit as described in U.S. Pat. No. 5,074,674. The entire bag pack 2 is supported at these three positions, namely, the two support arms 12 and the center hook 14.

When the bag 16 in the bag pack 2 immediately facing the bagger is pulled to open, the lower aperture 38 of the center mount 34 of the bag 16 is broken, thereby separating the bag 16 from the center hook 14 of the bag rack 4. During the opening process, the front wall 22 of the bag 16 is separated from its rear wall 24, and the bag handles 20 are separated from the other bags 6 in the bag pack 2 but are still suspended by the support arms 12 of the bag rack 4. Bag 40, which is immediately subsequent to the bag 16 in the bag pack 2, has a front wall 42 that is connected to the rear wall 24 of the bag 16 at the area of the releasable adhesive 8 while the bag 16 is being pulled open on the bag rack 4.

Advantageously, since the area of the releasable adhesive 8 is substantially centered between the bag handles 20 and positioned between the rear wall 24 of the bag 16 and the front wall 42 of the immediately subsequent bag 40 below the open top 28, the area of opening at the open top 28 of the bag 16 can be large when the bag 16 is opened on the bag rack 4 as shown in FIG. 2, thereby conveniently accommodating items with relatively large dimensions when they are placed into the bag 16.

Figure 3:
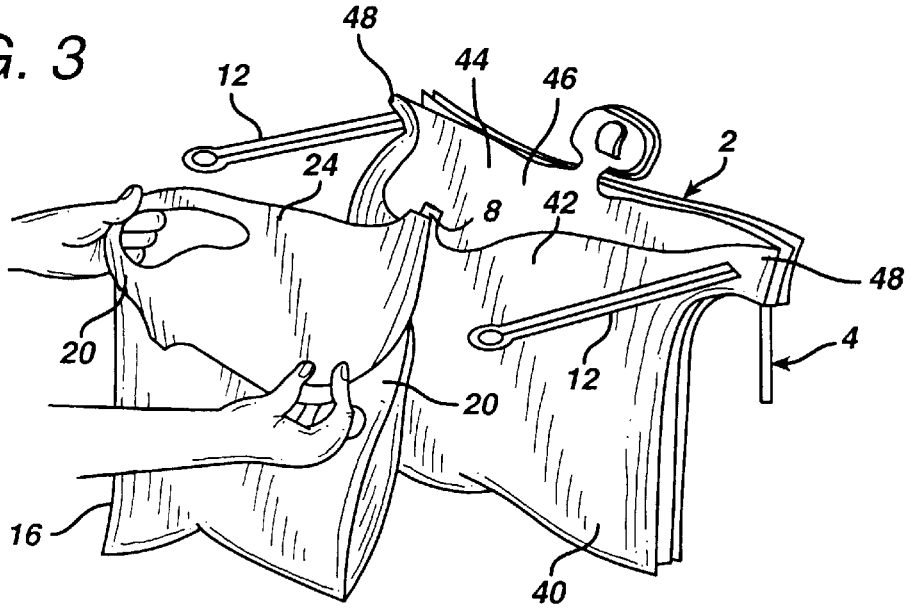
FIG. 3 is a perspective view of the bag pack of FIG. 1 with the selected bag of FIG. 2 removed from the bag pack and the bag immediately subsequent to the selected bag being opened and ready for loading.

FIG. 3 is a perspective view of the bag pack of FIGS. 1 and 2 showing the bag 16 immediately facing the bagger being removed from the bag pack 2 and the immediately subsequent bag 40 being pulled open by the releasable adhesive 8, thereby making the subsequent bag 40 ready for loading. The handles 20 of the bag 16 are removed from the support arms 12 of the bag rack 4 at this time, and the rear wall 24 of the bag 16, while still connected to the front wall 42 of the immediately subsequent bag 40 at the area of the releasable adhesive 8, is being peeled off from it while the bag 16 is pulled further away from the bag rack 4. When the front wall 42 of the immediately subsequent bag 40 is pulled away from the rear wall 44 by the pulling force applied to the adhesive 8, an opening 46 is formed between the front and rear walls 42 and 44 of the immediately subsequent bag 40. Bag handles 48 of the immediately subsequent bag 40 may also be moved partially forward on the support arms 12 of the bag rack 4. Therefore, the immediately subsequent bag 40 is ready for loading from the opening 46 as soon as the bag 16 is detached from the bag 40.

Figure 4:
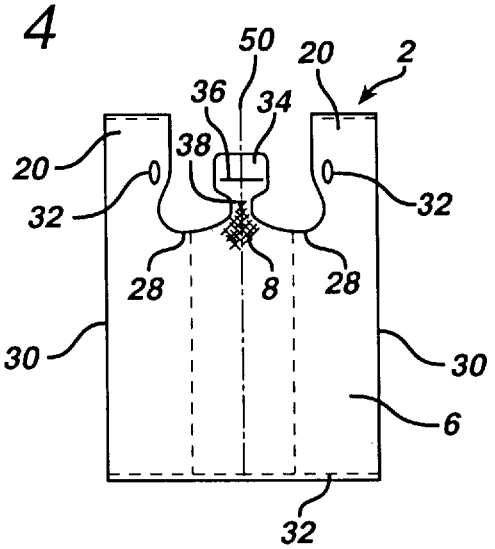
FIG. 4 is a front view of a bag in the bag pack of FIG. 1 prior to being mounted on the bag rack.

FIG. 4 is a front view of a bag 6 in the bag pack 2 of FIG. 1 prior to being mounted on the bag rack 4. The bag 6 has sealed opposed sides 30, a sealed bottom 32, and an unsealed open top 28 at which the front wall is separated from the rear wall when the bag 6 is pulled from the bag rack 4, as shown in FIGS. 2 and 3. The bag handles 20 and opposed sides 30 are substantially symmetric with respect to a longitudinal axis 50. A center mount 34, which is preferably a detachable tab at the center of the open top 28 of the bag 6 for attachment to the center hook 14 of the bag rack 4, is centered about the longitudinal axis 50 of the bag 6. As described above, the center mount 34 can include a mount aperture 36 for receiving the center hook 14 and a lower aperture 38 that is detachable when the bag 6 is pulled forward. The bag handles 20 each have a handle aperture 32 that is sized to fit one of the support arms 12 of the bag rack 4 as shown in FIGS. 1–3.

A releasable adhesive 8 is positioned on the walls of each bag so that the adjacent bags releasably adhere to each other in the bag pack 2. The area of the releasable adhesive is substantially centered about the longitudinal axis 50 of the bag 6, on the bag wall closer to the open top 28 than to the bottom 32. It is preferred that the area of the releasable adhesive 8 be positioned below the center mount 34, which is centered about the same longitudinal axis 50.

The bags 6 are preferably light weight, highly flexible, and strong thermoplastic material and are fabricated from a continuous plastic tube gusseted, flattened, and heat sealed at opposed upper and lower ends. The open top 28 of the bag 6 is formed by a cutout inwardly and centrally through the upper portion of the bag 6. This cutout defines the center mount 34 and the pair of laterally spaced handles 20 formed in the upwardly extending portions of the front and rear walls 22 and 24 of the bag 6, respectively. Additionally, the sides 30 can be pleated (not shown) or the bottom 32 can be pleated (not shown). The methods of sealing the front and rear walls 22 and 24 of the bag 6 at the opposed sides 30, the bottom 32 and the handles 20 are well known to a person skilled in the art and are not critical to the present invention.

The releasable adhesive 8 is preferably an adhesive that has a high shear strength but a low peel strength on plastic, and a low viscosity allowing for ease of application and relatively even distribution of the adhesive between the bags 6 in the area centered about the longitudinal axis 50 to which the adhesive 8 is to be applied. It is preferred that the releasable adhesive 8 be a cold releasable adhesive, that is, an adhesive with a relatively poor peel strength which need not be heated to lower its viscosity prior to application to the plastic bag walls. The cold releasable adhesive is preferably water-based with a slow rate of drying in room temperature to allow the adhesive to be placed between the bags without distorting the wall surfaces of the bags. For example, the releasable adhesive 8 can be a water-based cold adhesive, such as Aqualock™ 8003 brand adhesive, manufactured by BF Goodrich, Adhesive Systems Division, 123 West Bartges Street, Akron, Ohio 44311-1081. Typically, the Aqualock™ 8003 brand adhesive is about 35% water by volume in a condensed form prior to application. The Aqualock™ 8003 brand adhesive takes about 12 hours to dry and is non-flammable, non-toxic and pressure sensitive.

The physical properties of the Aqualock™ 8003 brand adhesive are as follows:

Base: acrylic

Color: white

Total solids: 65%

Solvents: none—only water

Thinner: water

Weight/gallon: 8.5 lb./gallon (1.02 kg/liter)

Calculated coverage: 1,000 SF/Gal/Mil (24 $m^2$/liter/0.254 mm)

Flashpoint: none

Viscosity: 900–1800 cps & 3Brkfd at 20 rpm pH: 7–8

Precautions: Do not freeze.

The size and the shape of the area of the cold releasable adhesive 8 varies according to the type of the adhesive used, the viscosity of the adhesive, and desired peel strength relative to the shear strength. For the Aqualock™ 8003 brand adhesive or a water-based cold adhesive with properties similar to it, the area of the adhesive 8 is preferably in the range of approximately 1 sq. inch to approximately 4 sq. inches. In a typical manufacturing process in which the adhesive is applied to the bag surfaces by a nozzle, the shape of the area of the adhesive 8 when the individual bags 6 are pressed together to form the bag pack 2 is approximately circular. The diameter of the approximately circularly shaped area of cold releasable adhesive 8 is preferably on the order of about 2 inches. It is preferred that the area of the cold releasable adhesive 8 be relatively large, typically between 1 sq. inch and 4 sq. inches, because for a given adhesive, large areas of adhesive have higher shear strength than smaller areas of adhesive. On the other hand, the peel strength per unit area remains the same. Therefore, when the rear wall 24 of the bag 16 is peeled away from the front wall 42 of the immediately subsequent bag 40 in FIG. 3, the peeling force is not excessively large to cause tearing of either bag wall 24 or 42. The shear strength of the cold releasable adhesive 8 is preferably much larger than its peel strength.

Optimally, water is added to dilute the Aqualock™ 8003 brand adhesive until the percentage is approximately 60% to 90% water by volume prior to application to the bag walls. With a high water content of about 60% to 90% by volume, the adhesive dries slowly and its viscosity is low. An advantage of a low viscosity adhesive is that when it dries on the bag walls after application, it produces a small peel strength compared to its shear strength.

Figure 8A:
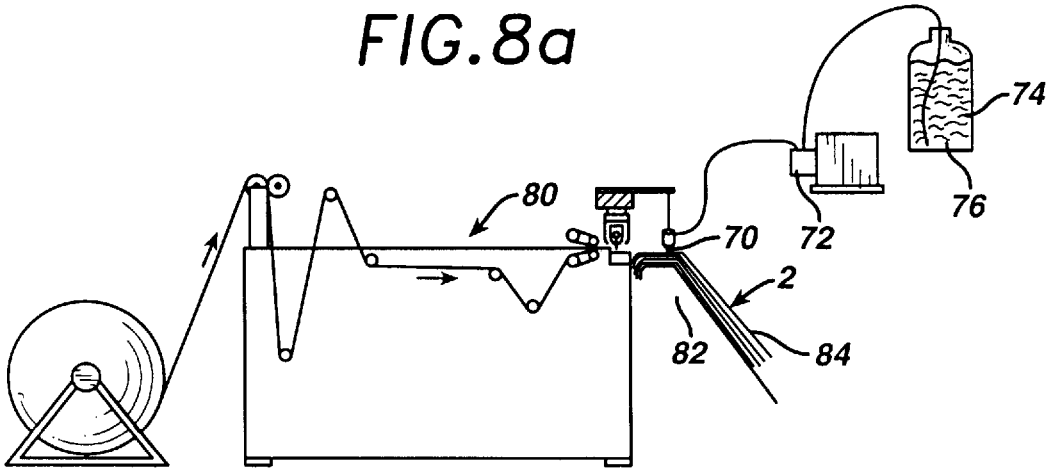
FIGS. 8*a* and 8*b* are simplified side and front views, respectively, of an embodiment of a machine that manufactures the bag pack in accordance with the present invention.
Figure 8B:
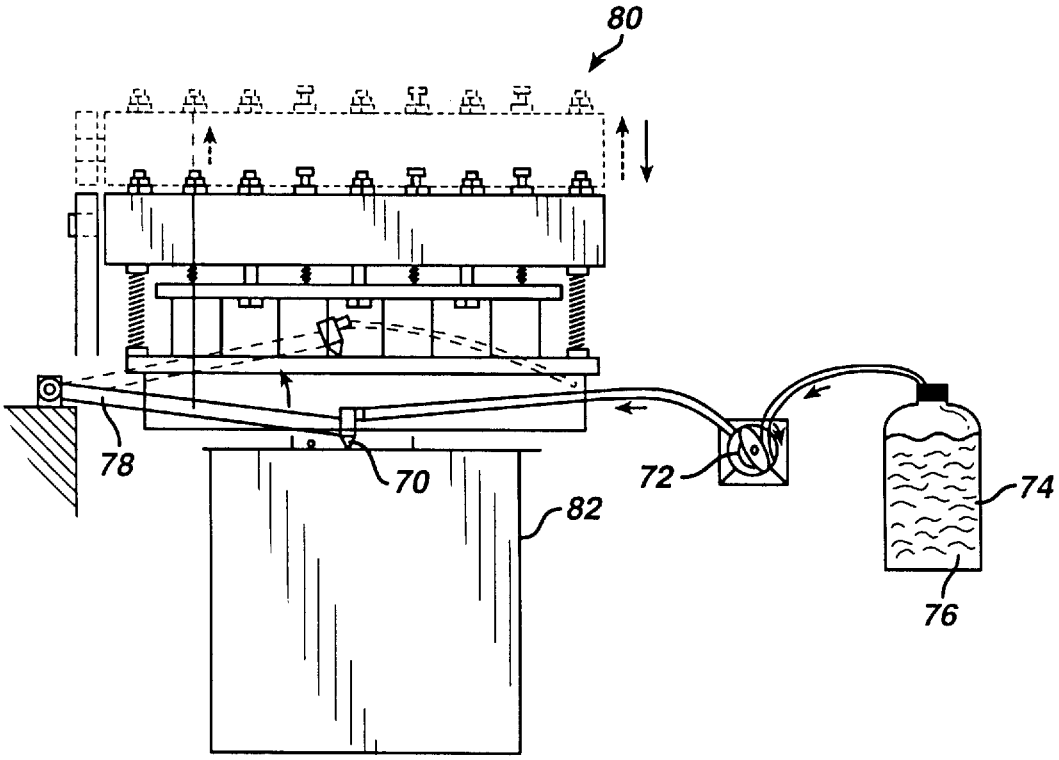

FIGS. 8*a* and 8*b* are simplified side and front views, respectively, of an embodiment of a machine that manufactures the bag pack 2 in accordance with the present invention. The cold releasable adhesive can be applied to the bag walls of the bag pack 2 through a nozzle 70 in FIGS. 8*a* and 8*b* or a sponge (not shown). In some applications, a nozzle is preferred over a sponge because the sponge may have to be changed often to prevent jamming the bag manufacturing equipment by the adhesive built up in the sponge. The nozzle or sponge is preferably connected to a fixed flow pump 72, which supplies the adhesive to the nozzle or sponge at a substantially fixed rate from a bottle 74 or a reservoir (not shown) that stores the cold releasable adhesive 76 in liquid form. An example of the pump 72 suitable for transferring the adhesive 76 is a Masterflex® L/S™ Easy-Load® pump head, manufactured by Barnant Company, 28W092 Commercial Avenue, Barrington, Ill. 60010-2392. The nozzle 70 is attached to a moveable lever 78 which moves upward and away from the bag pack 2 each time a bag is fed from bag manufacturing equipment 80 to a bag pack holder 82, which holds the bag pack while the nozzle 70 applies the adhesive 76 to the bag walls. When a bag 84 comes to a stop on the bag pack 2 resting on the holder 82, the lever 78 moves downward, and the nozzle 70 drops the adhesive 76 onto the bag 84, to form an area of the adhesive 8 on the bag wall substantially centered about the longitudinal axis 50 of the bag, the front view of which is shown in FIG. 4. The quantity of the adhesive dropped onto each bag is determined by the flow rate of the pump 72. FIGS. 8*a* and 8*b* illustrate only one embodiment of making the bag pack in accordance with the present invention; other embodiments are also feasible.

Figure 5A:
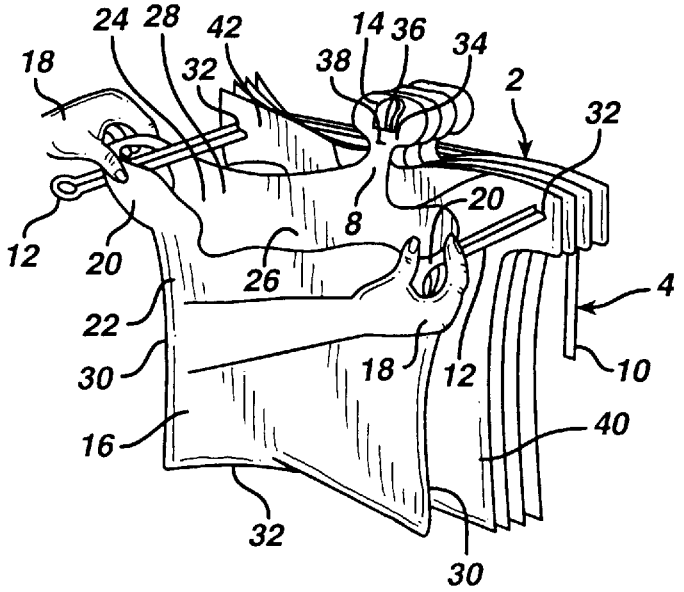
FIGS. 5*a* and 5*b* are perspective and sectional views, respectively, of the bag pack of FIG. 1 when the selected bag is being pulled open but with the rear wall of the bag still attached to the center mount.
Figure 5B:
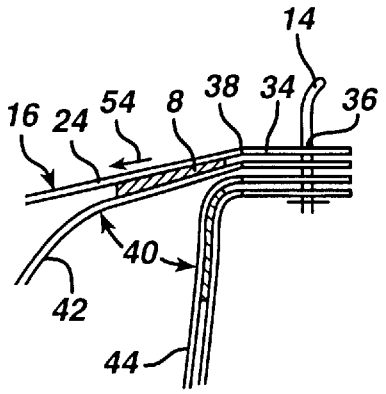

The operation of opening the bag 16 and pulling it away from the bag pack 2 in the preferred embodiment in which a relatively large area of cold releasable adhesive 8 produces a shear strength much larger than its peel strength is illustrated in FIGS. 5*a*, 5*b*, 6*a*, 6*b*, 7*a* and 7*b*. In FIG. 5*a*, the bag 16 is opened while the bag handles 20 are still suspended by the support arms 12 of the bag rack 4. The front wall 22 of the bag 16 is detached from the center mount 34, which is held by the center hook 14 of the bag rack 4. The bag enclosure 26 is opened at the open top 28 when the front wall 22 is separated from the rear wall 24 of the bag 16. At this time, the rear wall 24 of the bag 16 remains attached to the center mount 34 of the bag pack 2. The pulling force indicated by arrow 54 in FIG. 5*b* is substantially tangential to the surface of the rear wall 24 of the bag 16. The lower aperture 38 of the center mount 34, which is preferably a slit opening adapted to facilitate the detachment of the bag 16 from the center mount 34 upon application of a sufficiently large pulling force 54, is not broken when the bag handles 20 remain suspended on the support arms 12 of the bag rack 4 with the bag 16 ready for loading from the open top 28. When the rear wall 24 of the bag 16 is still attached to the center mount 34 fixed to the center hook 14 of the bag rack 4, the support arms 12 and the center hook 14 of the bag rack 4 support the weight of the items (not shown) placed into the bag 16 at the bag handles 20 and the center mount 34 of the bag 16, respectively.

Figure 6A:
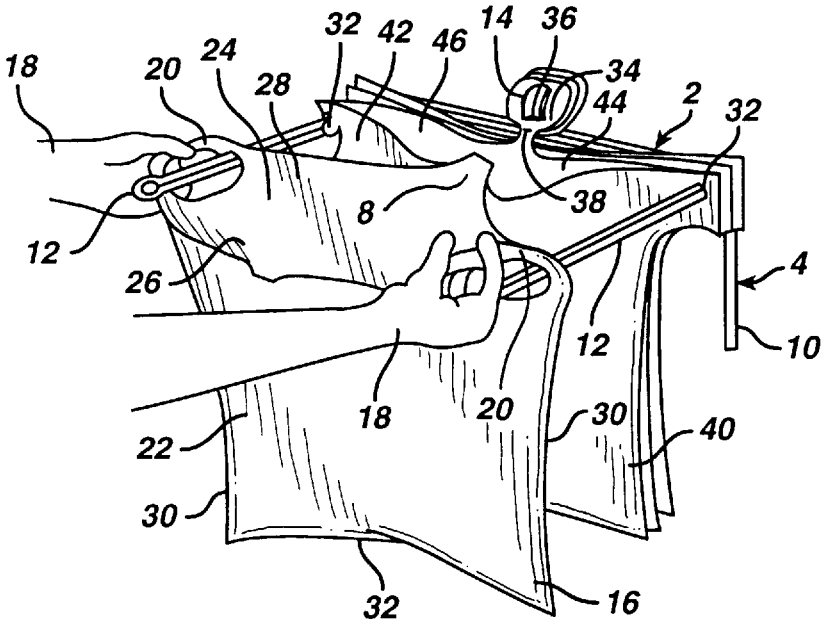
FIGS. 6*a* and 6*b* are perspective and sectional views, respectively, of the bag pack of FIGS. 5*a* and 5*b* when the selected bag is further pulled away from the bag pack and the rear wall of the selected bag is detached from the center mount.
Figure 6B:
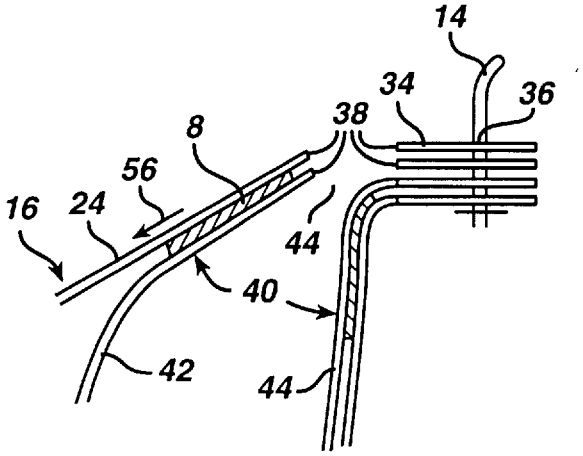

FIGS. 6*a* and 6*b* show the process of pulling the bag 16 further away from the bag pack 2, typically after the bag 16 is loaded. At this time, the rear wall 24 of the bag 16 and the front wall 42 of the immediately subsequent bag 40, attached together by the adhesive 8, are separated from the center mount 34 when the lower aperture 38 is broken. The pulling force indicated by an arrow 56 is larger than the force 54 illustrated in FIG. 5*b*, but is still substantially tangential to the surface of the rear wall 24 of the bag 16. Because the shear strength of the adhesive 8 is much larger than its peel strength, the front wall 42 of the immediately subsequent bag 40 remains attached to the rear wall 24 of the bag 16. When the front wall 42 of the immediately subsequently bag 40 is detached from the center mount 34 by the pulling force 56, an opening 46 is formed between the front and rear walls 42 and 44 of the immediately subsequent bag 40.

Figure 7A:
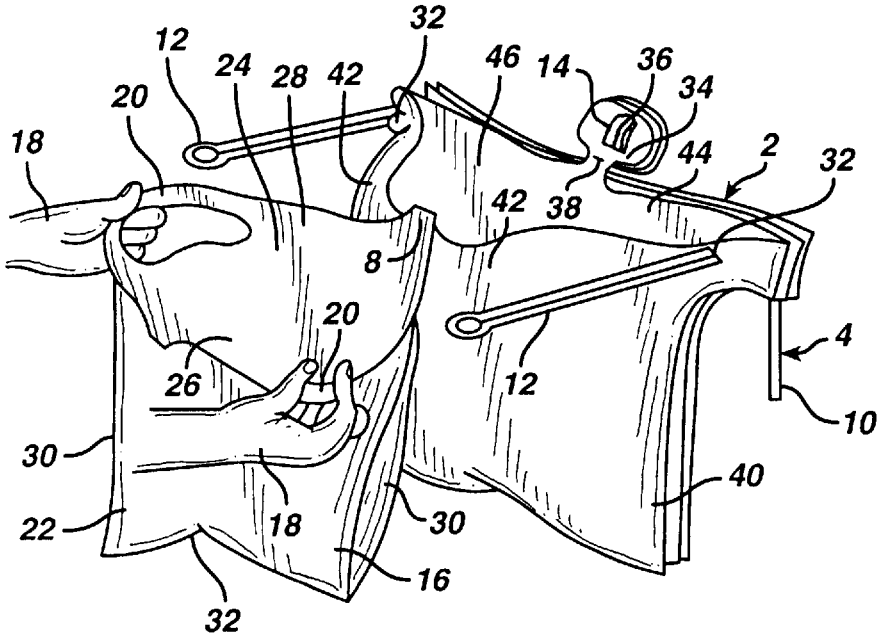
FIGS. 7*a* and 7*b* are perspective and sectional views, respectively, of the bag packs of FIGS. 6*a* and 6*b* when the selected bag is removed from the bag rack.
Figure 7B:
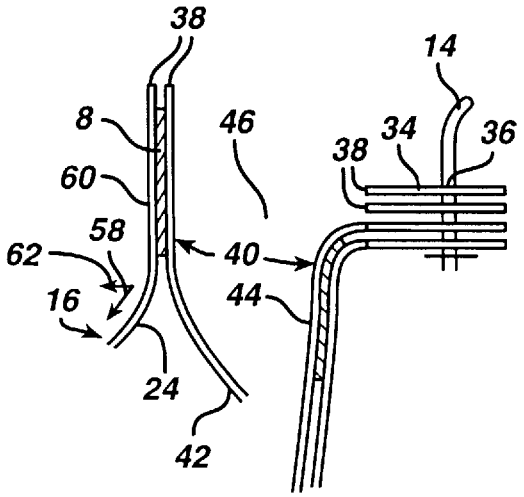

FIGS. 7*a* and 7*b* are perspective and sectional views, respectively, illustrating the opening of the immediately subsequent bag 40 when the bag 16 is removed from the bag rack 4 and the rear wall 24 of the bag 16 is peeled off from the front wall 42 of the immediately subsequent bag 40 at the area of the cold releasable adhesive 8. At this time, the pulling force indicated by an arrow 58 is no longer tangential to the surface portion 60 of the rear wall 24 of the bag 16 to which the cold releasable adhesive 8 is attached. The pulling force 58 has a normal vector component 62 which is substantially perpendicular to the surface portion 60 of the rear wall 24 of the bag 16. Therefore, the pulling force 58 acts upon the surface portion 60 as a peeling force to release the rear wall 24 of the bag 16 from the front wall 42 of the immediately subsequent bag 40. Since the peel strength of the cold releasable adhesive 8 is much weaker than its shear strength, it is relatively easy to peel the rear wall 24 of the bag 16 from the front wall 42 of the immediately subsequent bag 40 when the pulling force 58 has a normal vector component 62 that is substantially perpendicular the area of the cold releasable adhesive 8 in a direction that causes the rear wall 24 of the bag 16 to move away from the immediately subsequent bag 40.

While the rear wall 24 of the bag 16 is being peeled off from the front wall 42 of the bag 40, the opening 46 of the immediately subsequent bag 40 becomes wider and wider since the front wall 42 is further separated from the rear wall 44 of the immediately subsequent bag 40 by the pulling force 58. When the rear wall 24 of the bag 16 is completely detached from the front wall 42 of the immediately subsequent bag 40, the opening 46 of the immediately subsequent bag 40 is sufficiently large for loading on the bag rack 4.

After the bag 40 is loaded and removed from the bag rack 4 in a manner similar to the bag 16, bags subsequent to the bag 40 in the bag pack 2 can be loaded and removed from the bag rack 4 sequentially in the same manner as for bags 16 and 40. With a large opening formed in a subsequent bag when its immediately preceding bag is pulled from the bag rack, the need for the bagger to clear the opening for the subsequent bag is obviated, thereby expediting the bagging process.

Although the present invention has been described in considerable detail with reference to certain preferred versions thereof, other versions are possible. It is intended to cover all modifications, alternatives and equivalents which may fall within the spirit and scope of the invention as defined in the appended claims.

What is claimed is:

1. A method for manufacturing a bag suitable for releasable adhesion to an immediately subsequent bag in a bag pack suspended by laterally spaced support arms and a center hook of a bag rack, comprising the steps of:

(a) providing a continuous gussetted, flattened tube of thermoplastic material;

(b) cutting the thermoplastic material to form the bag, each bag comprising:

(i) a front wall having a longitudinal axis;

(ii) a rear wall having a longitudinal axis coinciding with the longitudinal axis of the front wall, the rear wall joined opposite the front wall defining an enclosure having an open top, opposed sides, and a bottom;

(iii) a pair of laterally spaced handles integral with the front and rear walls extending upwardly from the open top, each handle having a handle aperture extending therethrough for receiving one of the support arms of the bag rack;

(iv) a releasable center mount attached to the front and rear walls on the longitudinal axis of the walls adjacent the open top for receiving the center hook of the bag rack, the center mount releasably supporting the bag;

(c) sealing the front wall and the rear wall of each bag at the opposed sides, the bottom, and the handles;

(d) applying with a nozzle a cold releasable adhesive to an area on the rear wall, the cold releasable adhesive having:

(i) an acrylic base;

(ii) a water content in the range of about 60% water by volume to about 90% water by volume prior to application of the adhesive on each bag;

(iii) a viscosity in the range of about 900 centipoise to about 1800 centipoise prior to the addition of the water; and, (iv) a shear strength and a peel strength; and, wherein the area of the cold releasable adhesive is substantially centered about the longitudinal axis and positioned closer to the open top than to the bottom, the cold releasable adhesive adapted to releasably adhere to the front wall of the immediately subsequent bag, the area of the cold releasable adhesive being sufficiently large so that the shear strength required to release the cold releasable adhesive is greater than the peel strength required to release the center mount when the front wall is pulled from the back wall of the same bag; and, (e) drying the adhesive for a sufficient period of time prior to use.

2. The method of claim 1 wherein the applying the adhesive step further comprises applying the cold releasable adhesive to the area on the rear wall in a size in the range of about 1 square inch to about 4 square inches.

3. The method of claim 2 wherein the area of the cold releasable adhesive has an approximately circular shape with a diameter of about 2 inches.

4. The method of claim 1 wherein the applying the adhesive step further comprises applying the cold releasable adhesive to an area on the front wall, the area of the cold releasable adhesive on the front wall substantially centered about the longitudinal axis and positioned closer to the open top than to the bottom, the area of the cold releasble adhesive adapted to releasably adhere to the rear wall of an immediately preceding bag in the bag pack, the area of the cold releasable adhesive on the front wall being substantially the same as the area of the cold releasable adhesive on the rear wall.

5. The method of claim 1 wherein the applying the adhesive step further comprises using a pump apparatus that is coupled to the nozzle and that supplies the adhesive to the nozzle.

6. The method of claim 5 wherein the pump apparatus supplies the adhesive to the nozzle at a substantially fixed rate from a storage apparatus that stores the cold releasable adhesive.

7. The method of claim 1 wherein the drying step comprises drying the adhesive for a time period of at least 12 hours at ambient temperature.

8. A method for manufacturing a bag pack of stackable bags suitable for suspension by laterally spaced support arms and a center hook of a bag rack, comprising the steps of:

(a) providing a continuous gussetted, flattened tube of thermoplastic material;

(b) cutting the thermoplastic material to form a plurality of aligned stackable bags, each bag comprising:

(i) a front wall having a longitudinal axis;

(ii) a rear wall having a longitudinal axis coinciding with the longitudinal axis of the front wall, the rear wall joined opposite the front wall defining an enclosure having an open top, opposed sides, and a bottom;

(iii) a pair of laterally spaced handles integral with the front and rear walls extending upwardly from the open top, each handle having a handle aperture extending therethrough for receiving one of the support arms of the bag rack;

(iv) a releasable center mount attached to the front and rear walls on the longitudinal axis of the walls adjacent the open top for receiving the center hook of the bag rack, the center mount releasably supporting the bag;

(c) sealing the front wall and the rear wall of each bag at the opposed sides, the bottom, and the handles;

(d) applying with a nozzle a cold releasable adhesive to an area on the rear wall of each bag and the front wall of each immediately subsequent bag in the bag pack, the cold releasable adhesive having:

(i) an acrylic base;

(ii) a water content in the range of about 60% water by volume to about 90% water by volume prior to application of the adhesive on each bag;

(ii) a viscosity in the range of about 900 centipoise to about 1800 centipoise prior to the addition of the water; and, (iv) a shear strength and a peel strength; and, wherein the area of the cold releasable adhesive is substantially centered about the longitudinal axis and positioned closer to the open top than to the bottom, the cold releasable adhesive adapted to releasably adhere the rear wall of each bag to the front wall each immediately subsequent bag, the area of the cold releasable adhesive being sufficiently large so that the shear strength required to release the cold releasable adhesive is greater than the peel strength required to release the center mount when the front wall is pulled from the back wall of the same bag, and when the bag is removed from the bag rack by its handles, the peel strength required to release the cold releasable adhesive is less than the shear strength required to continue to pull the immediately subsequent bag out of the bag rack; and, (e) drying the adhesive for a sufficient period of time prior to use.

9. The method of claim 8 wherein the applying the adhesive step further comprises applying the cold releasable adhesive in a size in the range of about 1 square inch to about 4 square inches.

10. The method of claim 9 wherein the area of the cold releasable adhesive has an approximately circular shape with a diameter of about 2 inches.

11. The method of claim 8 wherein the applying the adhesive step further comprises using a pump apparatus that is coupled to the nozzle and that supplies the adhesive to the nozzle.

12. The method of claim 11 wherein the pump apparatus supplies the adhesive to the nozzle at a substantially fixed rate from a storage apparatus that stores the cold releasable adhesive.

13. The method of claim 8 wherein the drying step comprises drying the adhesive for a time period of at least 12 hours at ambient temperature.

14. A method for manufacturing a bag pack of stackable bags suitable for suspension by laterally spaced support arms and a center hook of a bag rack, comprising the steps of:

(a) providing a continuous gussetted, flattened tube of thermoplastic material;

(b) cutting the thermoplastic material to form a plurality of aligned stackable bags, each bag comprising:

(i) a front wall having a longitudinal axis;

(ii) a rear wall having a longitudinal axis coinciding with the longitudinal axis of the front wall, the rear wall joined opposite the front wall defining an enclosure having an open top, opposed sides, and a bottom;

(iii) a pair of laterally spaced handles integral with the front and rear walls extending upwardly from the open top, each handle having a handle aperture extending therethrough for receiving one of the support arms of the bag rack;

(iv) a releasable center mount attached to the front and rear walls on the longitudinal axis of the walls adjacent the open top for receiving the center hook of the bag rack, the center mount releasably supporting the bag;

(c) sealing the front wall and the rear wall of each bag at the opposed sides, the bottom, and the handles;

(d) applying with a nozzle a cold releasable adhesive to an area on the rear wall of each bag and the front wall of each immediately subsequent bag in the bag pack, the cold releasable adhesive having:

(i) an acrylic base;

(ii) a water content in the range of about 60% water by volume to about 90% water by volume prior to application of the adhesive on each bag;

(ii) a viscosity in the range of about 900 centipoise to about 1800 centipoise prior to the addition of the water; and, (iv) a shear strength and a peel strength; and, wherein the area of the cold releasable adhesive is substantially centered about the longitudinal axis and positioned closer to the open top than to the bottom, the cold releasable adhesive adapted to releasably adhere the rear wall of each bag to the front wall each immediately subsequent bag in the bag pack, the area of the cold releasable adhesive being about 1 square inch to about 4 square inches, so that the shear strength required to release the cold releasable adhesive is greater than the peel strength required to release the center mount when the front wall is pulled from the back wall of the same bag, and when the bag is removed from the bag rack by its handles, the peel strength required to release the cold releasable adhesive is less than the shear strength required to continue to pull the immediately subsequent bag out of the bag rack; and, (e) drying the adhesive for a period of time of at least 12 hours at ambient temperature.

* * * * *